United States Patent [19]

Olson

[11] Patent Number: 5,024,385

[45] Date of Patent: Jun. 18, 1991

[54] INTERNAL COMBUSTION ENGINE FUEL SUPPLY SYSTEM

[75] Inventor: Jeffrey A. Olson, Vernon Hills, Ill.

[73] Assignee: Outboard Marine Corporation, Waukegan, Ill.

[21] Appl. No.: 463,439

[22] Filed: Jan. 11, 1990

[51] Int. Cl.[5] ..... B05B 7/12

[52] U.S. Cl. ..... 239/410; 239/453; 239/533.6; 239/585

[58] Field of Search ..... 239/408, 409, 410, 453, 239/457, 458, 459, 456, 464, 506, 533.6, 533.7, 533.12, 585

[56] References Cited

U.S. PATENT DOCUMENTS

| | | | |
|---|---|---|---|
| 1,393,090 | 10/1921 | Cowardin et al. | 239/408 |
| 2,815,247 | 12/1957 | Hogeman | 239/456 |
| 2,975,982 | 3/1961 | Dahl | 239/453 |
| 3,128,948 | 4/1964 | De Luca | 239/132 |
| 3,387,790 | 6/1968 | De Luca | 239/453 |
| 3,693,889 | 9/1972 | Schuster | 239/533 |
| 4,164,326 | 8/1979 | Deckard | 239/453 |
| 4,213,564 | 7/1980 | Hulsing | 239/88 |
| 4,266,727 | 5/1981 | Happel et al. | 239/409 |
| 4,394,972 | 7/1983 | Potter | 239/453 |
| 4,531,676 | 7/1985 | Seifert et al. | 239/453 |
| 4,598,867 | 7/1986 | Trachte | 239/453 |
| 4,865,002 | 9/1989 | Borst | 123/532 |

FOREIGN PATENT DOCUMENTS

| | | | |
|---|---|---|---|
| 900977 | 7/1945 | France | 239/533.7 |

*Primary Examiner*—Andres Kashnikow
*Assistant Examiner*—Michael J. Forman
*Attorney, Agent, or Firm*—Michael, Best & Friedrich

[57] ABSTRACT

A fuel supply apparatus comprising a housing having therein a passageway including a valve seat adapted to communicate with a combustion chamber, and a bore adapted to communicate with a source of fuel under pressure, a valve member including a valve surface and a portion and being movable relative to the housing between a closed position wherein the valve surface engages the valve seat so as to close the passageway to the combusion chamber and the portion extends a first distance into the bore, and an open position wherein the valve surface is spaced from the valve seat so as to open the passageway to the combustion chamber and the portion extends a second distance less than the first distance into the bore, and an arrangement for adjusting the rate of fuel flow past the portion.

32 Claims, 2 Drawing Sheets

30
70
46
38
32
74
40
42
44
82
92
35
34
62
52
58
56
90
60
54
88
48
80
86
84
a
50
36

10
72
FUEL SOURCE
24
AIR COMPRESSOR
30
12
14
16
18
20
22

40
74
30
42
82
44
76

30
74
40
42
82
44
76

INTERNAL COMBUSTION ENGINE FUEL SUPPLY SYSTEM

RELATED APPLICATION

Attention is directed to U.S. Pat. No. 4,865,002, Sept. 12, 1989 and assigned to the assignee hereof.

Attention is also directed to U.S. Ser. No. 377,109, filed July 10, 1989 now U.S. Pat. No. 4,934,346, issued June 19, 1990 and assigned to the assignee hereof.

BACKGROUND OF THE INVENTION

The invention relates to fuel supply systems for internal combustion engines. More particularly, the invention relates to fuel injection systems and, still more particularly, to fuel injection systems for two-stroke internal combustion.

The invention also relates to arrangements for injecting a fuel/gas mixture into the air intake system or combustion chamber of an internal combustion engine. Furthermore, the invention relates to arrangements for injecting a mixture of compressed gas and fuel into the combustion chamber of an internal combustion engine.

The invention also relates to apparatus for providing a liquid/gas mixture.

Attention is directed to the following U.S. Patents:

| | | |
|---|---|---|
| Dahl | 2,975,982 | March 21, 1961 |
| Deluca | 3,128,948 | April 14, 1964 |
| Deluca | 3,387,790 | June 11, 1968 |
| Schuster | 3,693,889 | September 26, 1972 |
| Hulsing | 4,213,564 | July 22, 1980 |

SUMMARY OF THE INVENTION

The invention provides a fuel supply apparatus comprising a housing having therein a passageway including a valve seat adapted to communicate with a combustion chamber, and a bore adapted to communicate with a source of fuel under pressure, a valve member including a valve surface and a portion and being movable relative to the housing between a closed position wherein the valve surface engages the valve seat so as to close the passageway to the combustion chamber and the portion extends a first distance into the bore, and an open position wherein the valve surface is spaced from the valve seat so as to open the passageway to the combustion chamber and the portion extends a second distance less than the first distance into the bore, and means for adjusting the rate of fuel flow past the portion.

The invention also provides a liquid supply apparatus comprising a housing having therein a passageway including a valve seat adapted to communicate with a volume, and a bore adapted to communicate with a source of liquid under pressure, a valve member including a valve surface and a portion and being movable relative to the housing between a closed position wherein the valve surface engages the valve seat so as to close the passageway to the volume and the portion extends a first distance into the bore, and an open position wherein the valve surface is spaced from the valve seat so as to open the passageway to the volume and the portion extends a second distance less than the first distance into the bore, and means for adjusting the rate of fuel flow past the portion.

The invention also provides a fuel supply apparatus for an internal combustion engine combustion chamber, the apparatus comprising a housing defining a chamber adapted to communicate with the combustion chamber, means defining an orifice which communicates with the housing chamber and which is adapted to conduct fuel between a source of fuel under pressure and the housing chamber, valve means for opening and closing the housing chamber to the combustion chamber, and means for adjusting the size of the orifice.

The invention also provides a liquid supply apparatus comprising a housing defining a chamber adapted to communicate with a volume, means defining an orifice which communicates with the chamber and which is adapted to conduct fuel between a source of fuel under pressure and the chamber, valve means for opening and closing the chamber to the volume, and means for adjusting the size of the orifice.

A principal feature of the invention is the provisionof the above-described means for adjusting the size of the orifice communicating between the fuel injector and the fuel/gas chamber. This permits variation of the rate of fuel flow into the fuel/gas chamber.

Other features and advantages of the invention will become apparent to those skilled in the art upon review of the following detailed description, claims and drawings.

Figure 5:
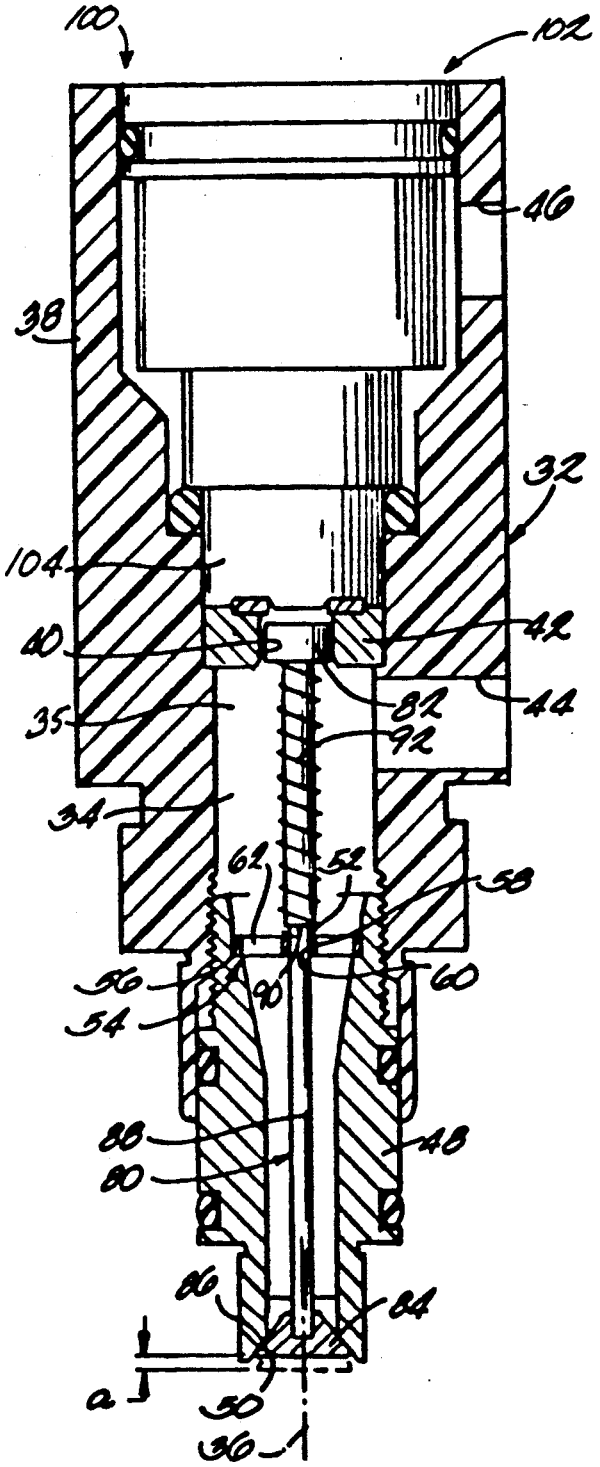
FIG. 5 is a view similar to FIG. 2 of an alternative embodiment of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 1:
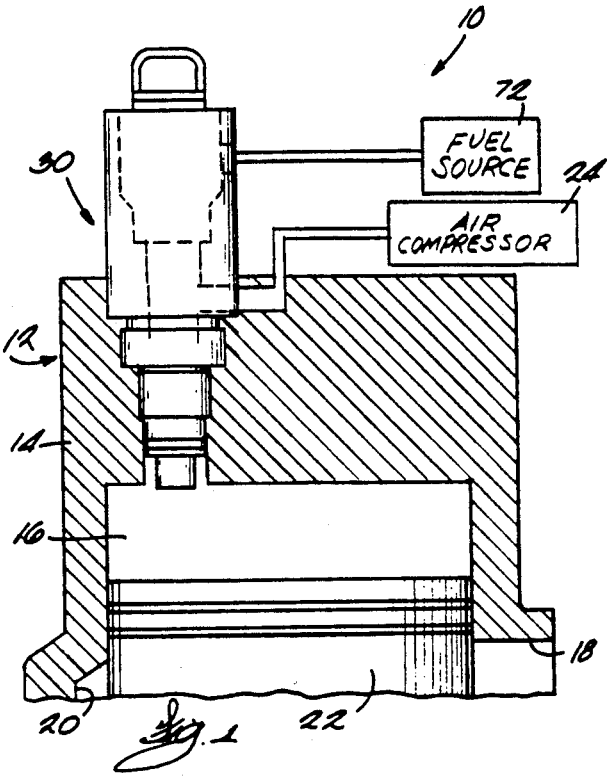
FIG. 1 is a partial view, partially in section, of an internal combustion engine including a fuel supply apparatus and embodying the invention.

A fuel supply system 10 for an internal combustion engine 12 is illustrated in FIG. 1. The engine 12 is preferably a two-stroke engine and includes an engine block 14 defining a combustion chamber or cylinder 16 and a crankcase (not shown) and including an exhaust port 18 and an inlet or transfer port 20, both of which communicate with the cylinder 16. The inlet 20 forms the downstream end of an air intake system including the crankcase and a carburetor (not shown). The engine 12 also includes a piston 22 movable in the cylinder 16 as is known in the art.

The fuel supply system 10 includes a source 24 of compressed gas or gas under pressure. Any suitable source can be used. In the preferred embodiment, the source 24 is an air compressor powered by the engine 12. In alternative embodiments, the source 24 can be an accumulation chamber and supply conduit and valve means such as those disclosed in above mentioned U.S. Pat. No. 4,865,002, which issued Sept. 12, 1989 and which is incorporated herein by reference.

The fuel supply system 10 also includes a fuel supply apparatus 30. The fuel supply apparatus 30 comprises a housing 32 which is supported by the engine block 14 and which defines a fuel/gas passageway 34 including a chamber 35 and having an axis 36. The housing 32 includes a first or upper portion 38 partially defining the passageway 34 and having therein a bore 40 defining the upper end of the passageway 34 and communicating with the chamber 35. In the preferred embodiment, the bore 40 is defined by a sleeve 42 supported by the upper housing portion 38. The lower end of the sleeve 42 is chamfered so that the lower end of the bore 40 is flared. The upper portion 38 also has therein a conduit 44 having one end communicating with the passageway 34 and an opposite end communicating with the source 24 of compressed air. The upper housing portion 38 also has therein a conduit 46, the reason for which is explained below. The housing 32 also includes a second or lower portion 48 partially defining the passageway 34 and having therein a valve seat 50 defining a bore which is spaced from the bore 40 and which forms the lower end of the passageway 34. (Thus, the passageway 34 includes the bore 40, the chamber 35, and the valve seat 50.) The valve seat 50 is preferably frustoconical and is adapted to communicate with the combustion chamber 16. The lower housing portion 48 also has therein a stop surface 52 which, in the preferred embodiment, is defined by a stop member 54 supported by the lower housing portion 48. The stop member 54 includes an annular outer portion 56 supported by the lower housing portion 48, an annular inner portion 58 having therethrough a bore 60, and a plurality of spokes 62 extending between the outer portion 56 and the inner portion 60 and defining therebetween a plurality of openings permitting fluid flow through the stop member 54. In the preferred embodiment, the lower housing portion 48 is threaded into the upper housing portion 38 such that rotation of the lower portion 48 relative to the upper portion 38 about the passageway axis 36 causes movement of the lower portion 48 relative to the upper portion 38 in the direction of the axis 36.

The fuel supply apparatus 30 also comprises a fuel injector 70 supported by the upper housing portion 38. Any suitable fuel injector can be used. In the preferred embodiment, the fuel injector 70 communicates, via the conduit 46, with a suitable source 72 of fuel and includes a nozzle 74 located above the bore 40. The fuel injector 70 is preferably electrically operated to periodically discharge pressurized fuel into the bore 40. More particularly, the fuel injector 70 is preferably solenoid operated.

The fuel supply apparatus 30 also comprises means defining an orifice 76 communicating between the fuel injector 70 and the chamber 35. While various suitable means can be employed, in the preferred embodiment, such means includes a valve member 80 having an upper portion or piston 82 extending into the bore 40 so that the orifice 76 is defined between the piston 82 and the sleeve 42. Thus, the orifice 76 is preferably, but not necessarily, annular. The valve member 80 also includes a lower portion 84 having thereon a valve surface 86 movable into and out of engagement with the valve seat 50 for closing and opening the passageway 34 to the combustion chamber 16. The valve surface 86 is complementary to the valve seat 50 and is preferably frustoconical. The valve member 80 also includes a stem 88 extending through the bore 60 in the stop member 54 and between the piston 82 and the lower portion 84. In the preferred embodiment, the stem 88 has thereon a step or stop surface 90 engageable with the stop surface 52 defined by the stop member 54.

Figure 2:
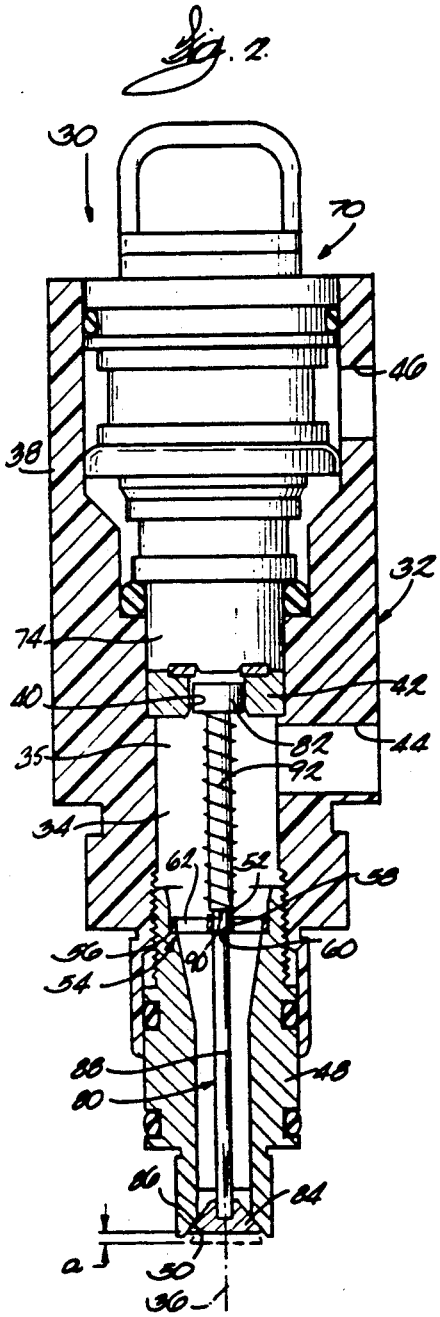
FIG. 2 is an enlarged view, partially in section, of the fuel supply apparatus.

The valve member 80 is movable between an upper or closed position (shown in solid lines in FIG. 2) and a lower or open position (shown in dotted lines in FIG. 2). In the upper position, the valve surface 86 engages the valve seat 50 so as to close the passageway 34 to the combustion chamber 16, the stem stop surface 90 is spaced above the stop surface 52, and the piston 82 extends a first distance into the bore 40. In the lower position, the valve surface 86 is spaced from the valve seat 50 so as to open the passageway 34 to the combustion chamber 16, the stem stop surface 90 engages the stop surface 52, and the piston 82 extends a second distance less than the first distance into the bore 40. Thus, the stop surfaces 52 and 90 limit downward movement of the valve member 80. It should be noted that the distance between the stop surfaces 52 and 90 when the valve member 80 is in the closed position is equal to the difference between the above-mentioned first and second distances. The valve member 80 and the valve seat 50 constitute valve means for opening and closing the passageway 34 or chamber 35 to the combustion chamber 16.

The fuel supply apparatus 30 further comprises means for biasing the valve member 80 upwardly or toward the closed position. While various suitable biasing means can be employed, in the preferred embodiment, such means includes a spring 92 surrounding the stem 88 and extending between the stop member 54 and the piston 82.

When the fuel injector 70 is not discharging fuel into the bore 40 or against the piston 82, the spring 92 maintains the valve member 80 in the closed position, wherein the valve surface 86 engages the valve seat 50 and the stem stop surface 90 is spaced above the housing stop surface 52. When the fuel injector 70 discharges fuel into the bore 40 and against the upper surface of the piston 82, the fuel pressure overcomes both the gas pressure in the chamber 34 and the force of the spring 92 and moves the valve member 80 downwardly until the stem stop surface 90 engages the housing stop surface 52. Thus, operation of the fuel injector 70 moves the valve member 80 to the open position. The fuel discharged by the fuel injector 70 flows between the sleeve 42 and the piston 82 and into the passageway 34, and the resultant fuel/air mixture in the passageway 34 flows past the lower portion 84 of the valve member 80, between the valve surface 86 and the valve seat 50, and into the combustion chamber 16.

The fuel supply apparatus 30 also comprises means for adjusting the size of the orifice 76, or for adjusting the rate of fuel flow past the piston 82. In the preferred embodiment, this means includes means for adjusting the position of the valve member 80 relative to the bore 40, and preferably for adjusting the position of the housing stop surface 52 relative to the bore 40. While various suitable means can be employed for adjusting the position of the stop surface 52, in the preferred embodiment, such means includes means for adjusting the position of the lower housing portion 48 relative to the upper housing portion 38. Preferably, this means includes the above-described threaded interengagement of the housing portions 38 and 48. As explained above, the position of the lower housing portion 48 relative to the upper housing portion 38 can be adjusted by rotating the lower housing portion 48 relative to the upper housing portion 38.

Figure 3:
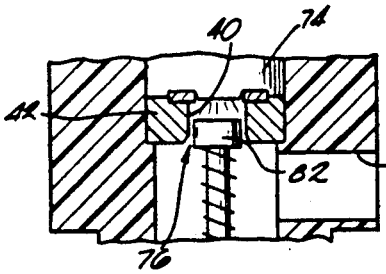
FIG. 3 is an enlarged, partial view of the fuel supply apparatus.
Figure 4:
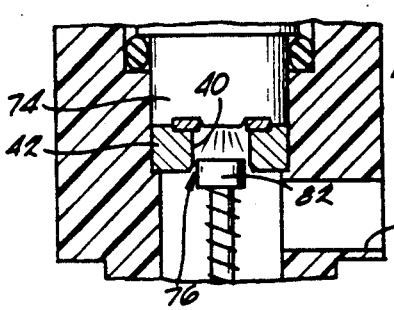
FIG. 4 is an enlarged, partial view of the fuel supply apparatus.

In FIG. 4, the lower housing portion 48 is in a lower position, relative to the upper housing portion 38, than in FIGS. 2 and 3. In other words, the distance between the lower housing portion 48 and the sleeve 42 is greater in FIG. 4 than in FIG. 3. As a result, the size or length of the orifice 76 is less in FIG. 4 than in FIG. 3. Accordingly, the rate of fuel flow past the piston 82 is greater in FIG. 4 than in FIG. 3.

It should be noted that adjustment of the position of the lower housing portion 48 does not affect the distance that the valve surface 86 moves relative to the valve seat 50 when the valve member 80 moves from the closed position to the open position. This is because the amount of movement of the valve member 80 is determined solely by the distance between the stop surfaces 52 and 90 when the valve member 80 is in the closed position, and this distance is not affected by movement of the lower housing portion 48 relative to the upper housing portion 38.

In alternative embodiments, the fuel supply apparatus 30 can communicate with any other portion of the air intake system, e.g., with the crankcase or with the carburetor. Since the air intake system communicates with the combustion chamber, communication with the air intake system constitutes communication with the combustion chamber.

A liquid supply apparatus 100 which is an alternative embodiment of the invention is illustrated in FIG. 5. Except as described hereinafter, the apparatus 100 is substantially identical to the fuel supply apparatus 30 of the preferred embodiment, and common elements have been given the same reference numerals. Instead of the fuel injector 70, the apparatus includes a device 102 for injecting a lubricant such as oil. The device 102 includes a nozzle 104 located above and communicating with the bore 40. The device 102 communicates with a suitable source of lubricant via the conduit 46.

The apparatus 100 is adapted to communicate with a volume such as the crankcase of an internal combustion engine to provide thereto an oil/air mixture. Alternatively, the apparatus 100 can communicate with any other portion of the engine that requires lubrication.

Various features of the invention are set forth in the following claims.

I claim:

1. A fuel supply apparatus comprising a housing having therein a passageway adapted to communicate with a combustion chamber and including a valve seat, and a bore communicating with said passageway and adapted to communicate with a source of fuel under pressure, a valve member including a valve surface and a portion spaced from said valve surface at a fixed distance and partially extending into said bore to define therebetween a fuel flow controlling orifice, said valve member being movable relative to said housing between a closed position wherein said valve surface engages said valve seat so as to close said passageway to the combustion chamber and said portion extends a first distance into said bore, and an open position wherein said valve surface is spaced from said valve seat so as to open said passageway to the combustion chamber and said portion extends a second distance less than said first distance into said bore, and means for adjusting the rate of fuel flow through said orifice and past said portion.

2. An apparatus as set forth in claim 1 wherein said means includes means for adjustably locating said valve member relative to said bore.

3. An apparatus as set forth in claim 2 wherein said housing has therein a stop surface, wherein said valve member has thereon a stop surface located to engage said housing stop surface when said valve member is in said open position, and wherein said adjusting means includes means for adjusting the position of said housing stop surface relative to said bore.

4. An apparatus as set forth in claim 1 and further comprising means for biasing said valve member toward said closed position.

5. An apparatus as set forth in claim 1 wherein said housing includes a first portion partially defining said passageway and having therein said bore, and a second portion partially defining said passageway and having therein said valve seat, and wherein said adjusting means includes means for adjustably locating said second housing portion relative to said first housing portion.

6. An apparatus as set forth in claim 5 wherein said second housing portion also has therein a stop surface, and wherein said valve member has thereon a stop surface located to engage said housing stop surface when said valve member is in said open position.

7. An apparatus as set forth in claim 1 wherein said housing also has therein a conduit which communicates with said passageway intermediate said bore and said valve seat and which is adapted to communicate with a source of gas under pressure.

8. A liquid supply apparatus comprising a housing having therein a passageway including a valve seat adapted to communicate with a volume, and a bore communicating with said passageway and adapted to communicate with a source of liquid under pressure, a valve member including a valve surface and a portion spaced from said valve surface and partially extending into said bore to define therebetween a liquid flow controlling orifice, said valve member being movable relative to said housing between a closed position wherein said valve surface engages said valve seat so as to close said passageway to the volume and said portion extends a first distance into said bore, and an open position wherein said valve surface is spaced from said valve seat so as to open said passageway to the volume and said portion extends a second distance less than said first distance into said bore, and means for adjusting the rate of liquid flow past said portion.

9. An apparatus as set forth in claim 8 wherein said means includes means for adjustably locating said valve member relative to said bore.

10. An apparatus as set forth in claim 9 wherein said housing has therein a stop surface, wherein said valve member has thereon a stop surface located to engage said housing stop surface when said valve member is in said open position, and wherein said adjusting means includes means for adjusting the position of said housing stop surface relative to said bore.

11. An apparatus as set forth in claim 8 and further comprising means for biasing said valve member toward said closed position.

12. An apparatus as set forth in claim 8 wherein said housing includes a first portion partially defining said passageway and having therein said bore, and a second portion partially defining said passageway and having therein said valve seat, and wherein said adjusting means includes means for adjusting the position of said second housing portion relative to said first housing portion.

13. An apparatus as set forth in claim 12 wherein said second housing portion also has therein a stop surface, and wherein said valve member has thereon a stop surface located to engage said housing stop surface when said valve member is in said open position.

14. An apparatus as set forth in claim 8 wherein said housing also has therein a conduit which communicates with said passageway intermediate said bore and said valve seat and which is adapted to communicate with a source of gas under pressure.

15. A fuel supply apparatus for an internal combustion engine combustion chamber, said apparatus comprising a housing defining a chamber adapted to communicate with the combustion chamber, means defining an orifice which communicates with said housing chamber and which is adapted to conduct fuel between a source of fuel under pressure and said housing chamber, valve means for opening and closing said housing chamber to the combustion chamber, and means for adjusting the size of said orifice independently of the operation of said valve means.

16. An apparatus as set forth in claim 15 wherein said housing has therein a bore, wherein said apparatus also comprises a member including a portion extending into said bore, and wherein said means defining said orifice includes said bore and said portion of said member.

17. An apparatus as set forth in claim 16 wherein said housing also includes a valve seat, wherein said member also includes a valve surface engageable with said valve seat, and wherein said valve means includes said valve surface and said valve seat.

18. An apparatus as set forth in claim 17 wherein said adjusting means includes means for adjustably locating said member relative to said bore.

19. An apparatus as set forth in claim 18 wherein said member is movable relative to said housing between a closed position wherein said valve surface engages said valve seat and an open position wherein said valve surface is spaced from said valve seat, wherein said housing has therein a stop surface, wherein said member has thereon a stop surface located to engage said housing stop surface when said member is in said open position, and wherein said adjusting means includes means for adjustably locating said housing stop surface relative to said bore.

20. An apparatus as set forth in claim 15 wherein said housing includes a valve seat, wherein said member includes a valve surface engageable with said valve seat, and wherein said valve means includes said valve surface and said valve seat.

21. An apparatus as set forth in claim 15 wherein said housing also has therein a conduit which communicates with said housing chamber intermediate said orifice and said valve means and which is adapted to communicate with a source of gas under pressure.

22. An apparatus as set forth in claim 15 wherein said housing includes a first portion partially defining said housing chamber and having therein a bore communicating with said chamber, and a second portion partially defining said housing chamber and having therein a valve seat communicating with said chamber, and wherein said apparatus also comprises a valve member including a valve surface and a portion spaced from said valve surface and partially extending into said bore to define therebetween an orifice controlling the rate of flow of fuel into said chamber, said member being movable between a closed position wherein said valve surface engages said valve seat and said valve member portion extends a first distance into said bore, and an open position wherein said valve surface is spaced from said valve seat and said valve member portion extends a second distance less than said first distance into said bore, wherein said valve means includes said valve member and said valve seat, and wherein said adjusting means includes means for adjustably locating said second housing portion relative to said first housing portion.

23. An apparatus as set forth in claim 22 wherein said second housing portion also has therein a stop surface, and wherein said valve member has thereon a stop surface located to engage said housing stop surface when said valve member is in said open position.

24. A liquid supply apparatus comprising a housing defining a chamber adapted to communicate with a volume, means defining an orifice which communicates with said chamber and which is adapted to conduct fuel between a source of fuel under pressure and said chamber, valve means for opening and closing said chamber to the volume, and means for adjusting the size of said orifice independently of the operation of said valve means.

25. An apparatus as set forth in claim 24 wherein said housing has therein a bore, wherein said apparatus also comprises a member including a portion partially extending into said bore, and wherein said means defining said orifice includes said bore and said portion of said member.

26. An apparatus as set forth in claim 25 wherein said housing also includes a valve seat, wherein said member also includes a valve surface engageable with said valve seat, and wherein said valve means includes said valve surface and said valve seat.

27. An apparatus as set forth in claim 26 wherein said adjusting means includes means for adjustably locating said member relative to said bore.

28. An apparatus as set forth in claim 27 wherein said member is movable relative to said housing between a closed position wherein said valve surface engages said valve seat and an open position wherein said valve surface is spaced from said valve seat, wherein said housing has therein a stop surface, wherein said member has thereon a stop surface located to engage said housing stop surface when said member is in said open position, and wherein said adjusting means includes means for adjustably locating said housing stop surface relative to said bore.

29. An apparatus as set forth in claim 24 wherein said housing includes a valve seat, wherein said member includes a valve surface engageable with said valve seat, and wherein said valve means includes said valve surface and said valve seat.

30. An apparatus as set forth in claim 24 wherein said housing also has therein a conduit which communicates with said housing chamber intermediate said orifice and said valve means and which is adapted to communicate with a source of gas under pressure.

31. An apparatus as set forth in claim 24 wherein said housing includes a first portion partially defining said housing chamber and a having therein a bore communicating with said chamber, and a second portion partially defining said housing chamber and having therein a valve seat communicating with said chamber, and wherein said apparatus also comprises a valve member including a valve surface and a portion spaced from said valve surface and partially extending into said bore to define therebetween an orifice controlling the rate of flow of fuel into said chamber, said member being movable between a closed position wherein said valve surface engages said valve seat and said valve member portion extends a first distance into said bore, and an open position wherein said valve surface is spaced from said valve seat and said valve member portion extends a second distance less than said first distance into said bore, wherein said valve means includes said valve member and said valve seat, and wherein said adjusting means includes means for adjustably locating said second housing portion relative to said first housing portion.

32. An apparatus as set forth in claim 31 wherein said second housing portion also has therein a stop surface, and wherein said valve member has thereon a stop surface located to engage said housing stop surface when said valve member is in said open position.

* * * * *